United States Patent [19]

Brachet

[11] Patent Number: 4,461,620

[45] Date of Patent: Jul. 24, 1984

[54] PROPULSION DEVICE AND A METHOD OF PROPELLING A NAUTICAL VESSEL

[76] Inventor: Roland Brachet, Domaine d'Arnaga, Callian, France, 83810

[21] Appl. No.: 201,771

[22] Filed: Oct. 29, 1980

Related U.S. Application Data

[63] Continuation of Ser. No. 945,500, Sep. 25, 1978, abandoned.

[30] Foreign Application Priority Data

Oct. 5, 1977 [FR] France ..... 77 30020

[51] Int. Cl.[3] ..... B63H 11/02

[52] U.S. Cl. ..... 440/38; 440/49; 440/90

[58] Field of Search ..... 440/38, 40–43, 440/47, 90, 94, 45, 49; 239/546

[56] References Cited

U.S. PATENT DOCUMENTS

| | | | |
|---|---|---|---|
| 68,712 | 9/1867 | Crook | 239/546 |
| 441,965 | 12/1890 | Owen | 440/40 |
| 2,369,996 | 2/1945 | Baker | 440/90 |
| 3,183,878 | 5/1965 | Aschauer | 440/38 |
| 3,273,529 | 9/1966 | Senkewich | 440/66 |
| 3,680,315 | 8/1972 | Aschauer et al. | 60/221 |
| 3,763,818 | 10/1973 | Davis | 60/222 X |
| 3,985,094 | 10/1976 | Stricker | 60/222 X |
| 3,996,871 | 12/1976 | Boismard | 114/61 |

FOREIGN PATENT DOCUMENTS

| | | | |
|---|---|---|---|
| 1161782 | 1/1964 | Austria . | |
| 9365 | 2/1907 | Denmark . | |
| 698588 | 10/1953 | United Kingdom | 440/45 |

*Primary Examiner*—Sherman D. Basinger

*Attorney, Agent, or Firm*—Sandler & Greenblum

[57] ABSTRACT

A propulsion device comprises a water intake and a conduit for conveying water from the intake to an aperture. Apparatus is provided for forcing the water through the aperture in the form of a water jet as well as for subdividing the water into segments and accelerating each of the segments into the air. The method for propelling the nautical vessel comprises flowing water through a water intake in the vessel and conveying the water through a conduit from the intake to an aperture. The water is forced through the aperture in the form of a water jet and subdivided into segments which are accelerated into the air so as to provide a reaction force for propelling the nautical vessel.

14 Claims, 11 Drawing Figures

PROPULSION DEVICE AND A METHOD OF PROPELLING A NAUTICAL VESSEL

This application is a continuation of application Ser. No. 945,500, filed Sept. 25, 1978, now abandoned.

BACKGROUND OF THE INVENTION

1. Field of the Invention

The invention relates to means for providing mechanical energy to propel vessels and the like. The invention also relates to a method of propelling vessels by mechanical means.

2. Description of the Prior Art

The most conventional and widely used type of marine propeller is the screw type. The propeller is arranged under the hull of the vessel, usually aft, and it is rotably driven by a shaft slanting downwards from the fore end to the aft end where it passes through the hull and is connected to the shaft of the device providing the motor power. The blades of the screw are arranged so as to ensure that the water taken in from in front of them will be thrust backwards at an increased speed. This increase corresponds exactly to the factor by which the required propulsion force is generated.

The apparent simplicity of such a propeller conceals a number of difficulties inherent therein. These difficulties include not only those connected with the process of producing the propeller, such as the necessity of extending the shaft through the hull without causing any leaks in the latter, fixing the bearings which guide the rotation of the shaft, ensuring resistance to vibrations, and the like, but also problems of a technical and even scientific nature. For example, the exact quantitative theory governing the operation of the propeller still remains to be defined and the empirical method is the only way to determine the optimum shape of the propeller blades. It is only by lengthy and laborious adjustments and improvements and by successive tests at sea that the speed of the vessel can be correctly coordinated with the power supplied by the motor, given that at a low speed the thrust imparted to the vessel will be comparatively limited. The impedance or resistance of the marine propeller cannot be regulated, except in the very rare and complex case of a screw mechanically manufactured such that its thread may be varied. Furthermore, the ratio of the power used for the propulsion of the vessel to that actually supplied by the motor remains low, despite almost a century of research in an attempt to improve it. To this day the ratio remains on the order of 0.5. Finally, the screw propulsion system further suffers from the drawback that the propeller is underneath the vessel and thus in a position where damage can be a serious problem due to the difficulty of repairing it.

In order to overcome most of the aforementioned drawbacks, a "hydrojet" or "jet propeller" device based on a different principle has been designed and is now being developed to a considerable extent. The so-called "jet propeller" or "hydrojet" enables the propeller to be dispensed with and comprises a water intake, either of the scoop type or of the parietal type, conveying the water through a conduit, known as a suction intake, to a pump which increases the level of kinetic energy of the water supplied and conveys it aft via an ejection circuit terminating in a nozzle through which the water is finally ejected aft at a high speed.

Such devices represent a definite advance over the prior art and while they make it possible to navigate on shoals and eliminate the need for screw propeller movements, they suffer from numerous drawbacks and particularly from various problems involved in installing the complex and expensive pump equipment.

Although various pump embodiments such as those of the centrifugal or axial type, a pump with elements in parallel or with elements in series, or with a combination of fixed and movable blades, and the like may be used, performance remains subject to the limits imposed by the hydrodynamic principles governing continuous and incompressible fluids. Pumps of this kind, which also suffer from the phenomenon known as cavitation, do not provide an overall propulsion efficiency significantly greater than conventional screw type propellors.

SUMMARY OF THE INVENTION

It is, therefore, an object of the invention to overcome the above mentioned drawbacks.

It is a further object of the invention to provide a device having a far higher propulsion efficiency than had been previously achievable with conventional prior art propulsion devices.

It is yet another object of the invention to provide a method for propelling a vessel which makes it possible to achieve high propulsion efficiency while overcoming many of the problems inherent in common propulsion devices.

According to the invention a propulsion device is provided which comprises a water intake and a conduit for conveying water from the intake to an aperture. The device further comprises first means for forcing the water through the aperture in the form of a water jet as well as second means for subdividing the water jet into segments and accelerating the segments.

According to the method of the invention a nautical vessel is propelled by a method which comprises flowing water through a water intake in the vessel and conveying the water through a conduit from the intake to an aperture. The water is forced through the aperture in the form of a water jet and is then subdivided into segments and accelerated so as to provide a reaction force for propelling the nautical vessel.

DESCRIPTION OF THE PREFERRED EMBODIMENTS

Figure 1:
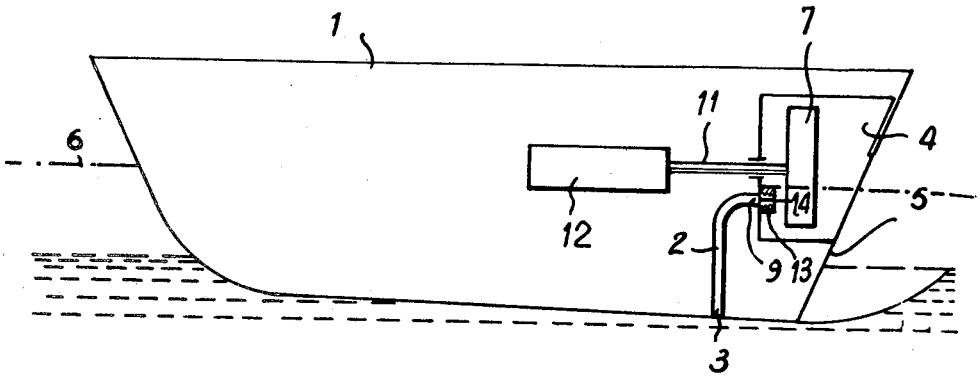
FIG. 1 illustrates a schematic side view of a vessel operating on the hydroplane principle.
Figure 2:
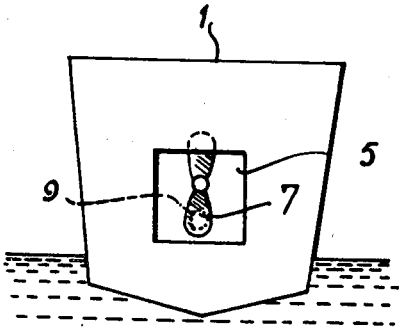
FIG. 2 shows a rear elevational view of the device shown in FIG. 1.
Figure 3:
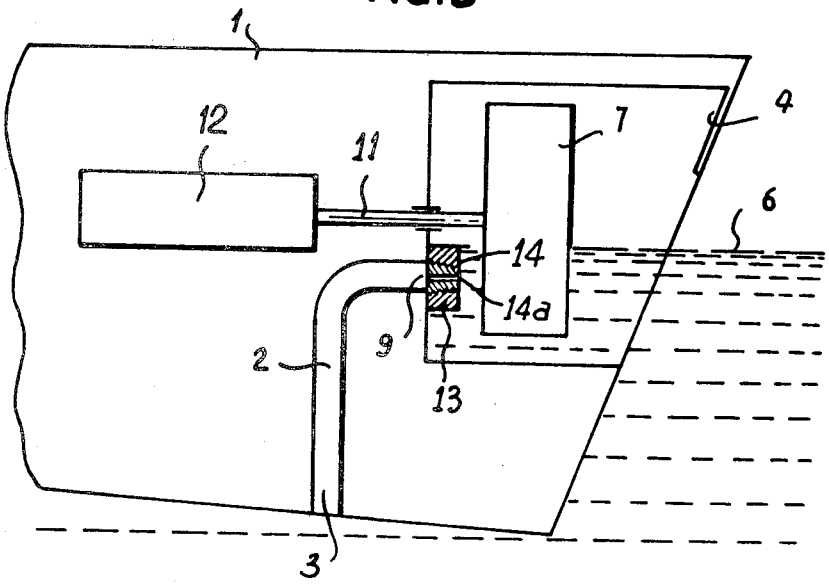
FIG. 3 is a magnified sectional side view of the aft part of the vessel shown in FIG. 1, the vessel being assumed to be stationary.
Figure 4:
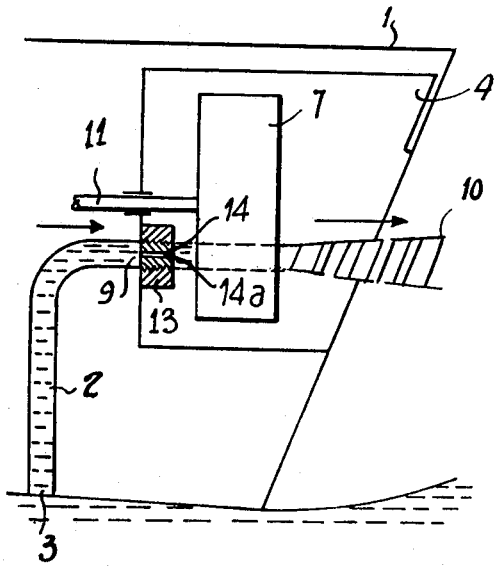
FIG. 4 illustrates a view similar to that of FIG. 3 with the vessel in operation according to the hydroplane principle.
Figure 6:
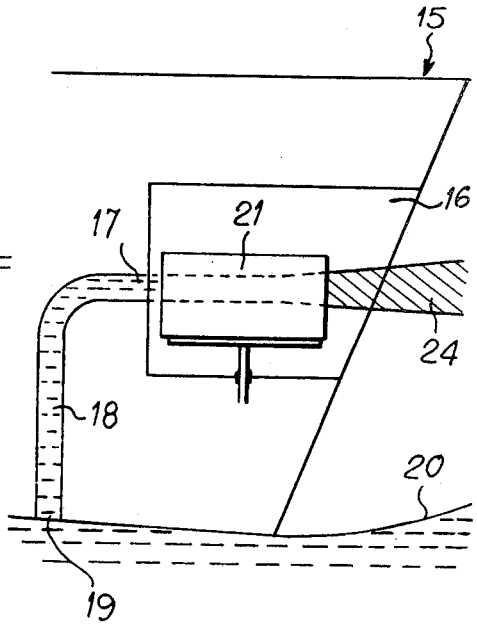
FIGS. 5 and 6 illustrate a second embodiment of the invention illustrated in FIGS. 3 and 4.
Figure 5:
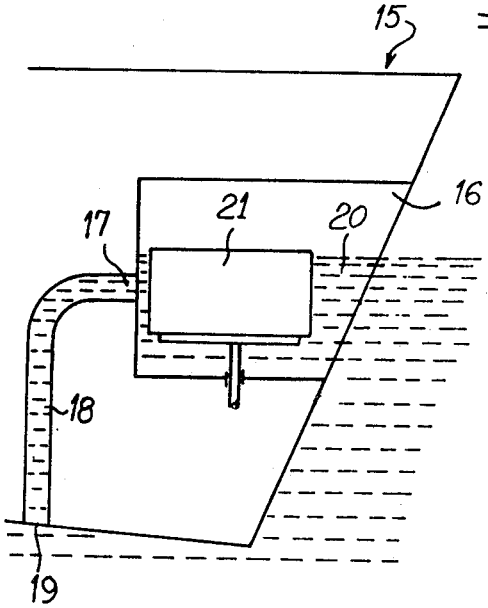

The marine propulsion device according to the invention comprises a water intake, a conduit for conveying the water from the intake to an aperture aft, and means for forcing the water in the form of a jet through the aperture. The device further comprises means for subdividing the jet, each section of the latter being projected with an acceleration.

The inventive apparatus provides a very simple device ensuring high propulsion efficiency. The construction of a device of this kind is very different from that of jet propellers or hydrojet systems, whose performance depends on pumps. The jet projected has practically no influence on the result, since the propulsive effect is obtained by acceleration in air of the segments of water detached from the jet.

According to the first embodiment, the means for the subdivision of the jet and the projection of each separate resulting segment with an acceleration comprises a screw propeller fitted or attached onto a motor shaft serving to drive it. The blades are arranged in the trajectory followed by the water jet. The device thus dispenses with propellers immersed underneath the hull and thus obviates all the disadvantages entailed thereby.

In an alternative embodiment of the invention the means for subdividing the jet and projecting each separate resulting segment with an acceleration comprises a turbine fitted onto a motor shaft which serves to drive it. The path described by the propeller blades is located in the trajectory followed by the jet.

Means are provided for modifying the cross section of the jet so that the impedance of the jet can be adapted to that of the motor under particular operating conditions and at particular motor speeds.

In order to increase the efficiency of the device covered by the invention, the turbine may comprise means to cause the blades to retain a constant orientation while rotating; their orientation being preferably such as to ensure that the blades attack the jet of water in a direction substantially perpendicular to its axis.

According to a further aspect of the invention the turbine comprises means for modifying the orientation of the blades. The angle at which the segments of water detached from the jet are projected can thus be varied, providing a simple means of steering the vessel.

In one embodiment, the turbine comprises an inner pinion and at least one movable gear connected to a motor, in order to rotate about the first pinion, and comprising at least one intermediate pinion engaging the inner pinion, and at least one outer pinion of the same diameter as the inner pinion and engaging the intermediate pinion. The outer pinions each support a blade, while the inner pinion is connected to means for modifying its angular position as desired.

According to another embodiment, the means for subdividing the jet and projecting and accelerating each segment of water is positioned in a reaction chamber situated aft and open at the rear, while the aperture through which the jet emerges opens into the chamber.

In yet another embodiment, the reaction chamber is situated at a level such that it is partially summerged when the vessel is motionless, while the means for subdividing the jet and projecting each resulting segment of water with an acceleration is likewise at least partially submerged when in this portion. In the case of a vessel of the hydroplane variety, for example, the jet subdivision means may be utilized as a starting propulsion device for the vessel.

FIGS. 1, 2, 3, and 4 are schematic diagrams of a nautical vessel 1 constructed to operate on the hydroplane principle. When operating on this principle, when in motion, the boat is inclined to the horizontal such that the bow of the boat is at least slightly raised relative to the stern because of which water is forced through conduit 2. The vessel comprises a water intake 3 connected by a conduit 2 to a reaction chamber 4 comprising a recess opening towards the rear and provided in the aft panel 5 of the vessel. Reference numeral 6 illustrates the water line of the vessel 1 when it is stationary.

The reaction chamber 4 contains a device 7 which, as illustrated in its simplest form, comprises a propeller with two blades, for example, fitted onto an output shaft 11 of a motor 12.

The conduit 2 leads into the chamber 4 below the shaft 11, via a horizontal nozzle 9. The nozzle 9 is shown schematically and comprises a ring 13 with a frustoconical threaded bore which coacts with the corresponding threading on an end 14 of the conduit 2 which is provided with slits 14*a*.

The operation of the propulsion device as shown in FIGS. 1–4 will now be described.

With the vessel at a standstill the chamber 4 is partly filled with water since its lower end is situated below the water line 6 when the vessel is stationary. The motor 12 is started up, thus driving the helical or screw propeller 7, which acts to expel water from the reaction chamber 4 towards the rear, so that the vessel moves. As long as the propeller 7 is driven at a low number of revolutions per minute, the level of the water in the chamber 4 will only vary to a small extent since the water expelled towards the rear is replaced by water supplied by the conduit as a result of static pressure. As illustrated in FIGS. 1–4, at least a part of both propeller 7 and reaction chamber 4 continuously remain above the water line 6 so that the water jet being forced through nozzle 9 can be subdivided into small segments which are accelerated into air above the water line by the propeller.

If a higher speed of rotation is selected for the helical propeller 7 at an initial stage, the speed of the vessel will be increased as a result of the greater mass of water expelled by the propeller, until the vessel rises above flotation level. Dynamic pressure will prevail in the water intake 3, so that water ascends in the conduit 2 and emerges through the aperture 9, forming a jet of water 10 directed horizontally aft. The jet 10 is led into the action zone of the blades of the propeller 7, which take it up and subdivide it into separate segments which are accelerated and expelled aft at an increased speed.

A device of this kind is very simple, it being understood that the blades must be given a suitable profile in order to enable then to cut the jet of water under pressure and to accelerate the respective segments thereof.

One advantage of the invention resides in the fact that it is possible to drive the vessel in the reverse direction, at a low speed, simply by reversing the direction of rotation of the shaft. Furthermore, as a result of the nozzle 9, the cross section of the passage can be modified in order to regulate the cross section of the jet, so that under certain operating conditions and at certain speeds of the motor 12, the impedance of the jet can be adapted to that of the motor.

FIGS. 5–8 show an alternative embodiment of the invention, which can be used, as in the case of the preceeding figures, for a vessel designed to operate on the hydroplane principle. Since the vessel is of the same type as that shown in the preceeding Figures, discussion of FIGS. 5–8 will be confined to the aft portion of the vessel, which is equipped with a propulsion device according to the invention.

As shown in FIGS. 5–8, the vessel 15 is provided, in its aft plate, with a horizontal aperture 17 which leads into a reaction chamber 16 connected by a conduit 18 to a water intake 19 situated in the hole. The aperture 17 is positioned along the longitudinal axis of the hull.

Figure 8:
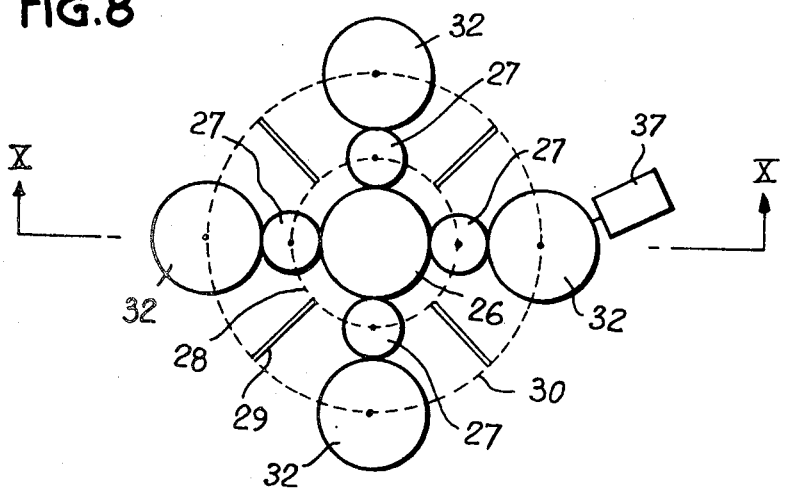
FIG. 8 is a schematic diagram of the turbine illustrated in FIGS. 5 and 6.
Figure 9:
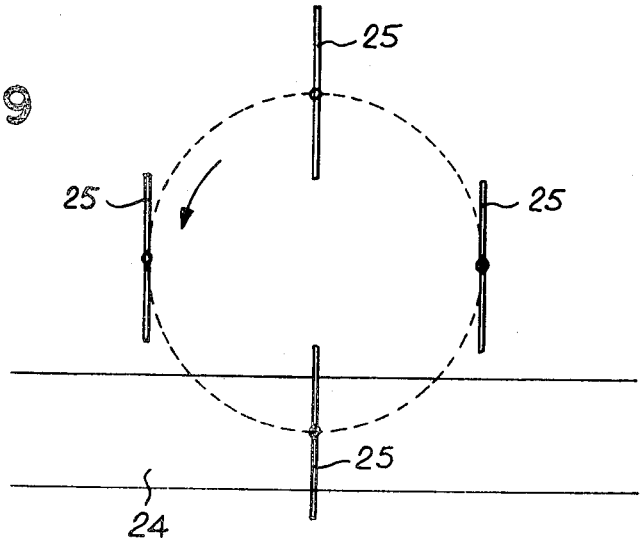
FIG. 9 is a schematic diagram of the turbine blades of the turbine illustrated in FIG. 8.
Figure 10:
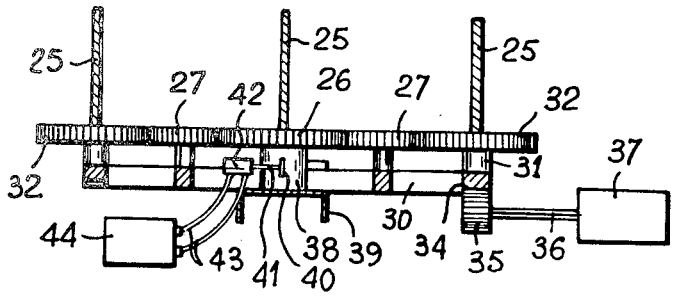
FIG. 10 is a sectional view along the line X—X of FIG. 8.

The reaction chamber 16 contains a turbine 21 with a vertical shaft. The turbine, which is shown in greater detail in FIGS. 8, 9, and 10, is so arranged that its blades 25 define a circular path and remain parallel to one another. The turbine comprises an inner pinion 26 which engages four intermediate pinions 27 which are mounted 90° apart. The axes of the shafts are supported by a circular rim 28 connected by cross members 29 to a concentric circular rim 30. The rim 30 supports four shafts 32 mounted 90° apart. Outer pinions 32 arranged to each engage an intermediate pinion 27 are rotably mounted on rim 30. The lower surface of the rim 30 is provided with a system of teeth 34 interacting with a pinion 35 fitted onto the output shaft 36 of a motor 37.

The pinions 26 and 32 are of the same diameter, and the pinion 26 is fitted onto a shaft 38 supported by a vertical bearing 39. The shaft 38 comprises a radial lug 40 to which is affixed the free end of the rod 41 of a double action jack 42 comprising lines 43 designed to be connected to a distributor 44.

Each of the blades 25 is integral with the upper surface of the pinion 32. The blades are arranged in parallel planes. It is to be understood that when the motor 37 drives the toothed rim 30 via the gearing 35 the pinions 32 and 27 will rotate together about pinion 26, the orientation of the blades 25 remaining constant. If it is desired to vary the orientation of the blades 25 it is only necessary to operate the distributor 44 in order to alter the angular position of the shaft 38.

Figure 7:
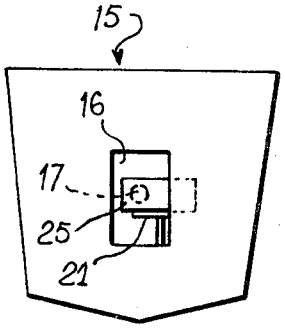
FIG. 7 is a rear elevational view of the vessel shown in FIGS. 5 and 6.

As may be seen from FIGS. 7 and 9, apertures 17 are offset with respect to the axis of the turbine 21. The blades 25 attacking the jet of water 24 in a direction substantially perpendicular to the axis of the latter and subdivide it into portions in order to accelerate their movement.

The blades 25 will preferably be thin but nevertheless sufficiently thick to provide the required strength, so that the perpendicular component of the movement corresponding to the introduction of the blades into the jet of liquid will only be of moderate consequence from the point of view of energy.

The operation of the device shown in FIGS. 5–10 will now be described.

The vessel 15 is of the type operating on the hydroplane principle, and the turbine 21, when it is stationary, is at least partly submerged under the water line 20, so that the reaction chamber 16 is partly submerged. Since the opening of the reaction chamber 16 aligns with only a portion of the turbine 21, the other part being masked, the turbine 21 will expel the water contained in the reaction chamber 16 when the turbine is operated to force water in that direction. When the turbine is driven at a low speed, this action will cause the vessel to move slowly.

If the revolution rate of the motor is increased, the speed will likewise increase and the vessel will ride up in the water. A dynamic pressure is generated in the water intake 19, so that the water rises in the conduit 18 and emerges through the aperture 17 in the form of a horizontal jet 24. The jet is subdivided into segments by the blades 25, which expels them towards the rear at an increased speed, where they are broken up and diffused through the aperture of the reaction chamber 16.

By operating the distributor 44 it is possible to modify the angular position of the shaft 38 and thus to vary the orientation of the blades 25. As a result, it is possible, without recourse to any other control device, on modifying the ejection of the separate segments of the jet, to provide a system for steering the vessel by a lateral reaction effect.

Figure 11:
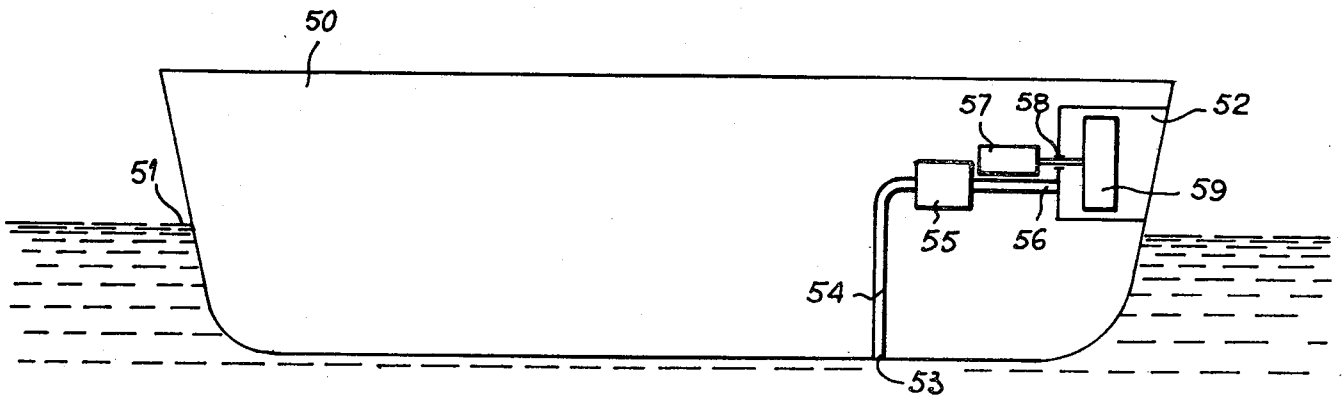
FIG. 11 is a side sectional view of a further embodiment of the invention.

The device to which the invention relates is particularly suitable for vessels moving at a high speed on the hydroplane principle but may, nevertheless, prove very advantageous, because of its simplicity and its high efficiency, for vessels which do not substantially rise above their normal flotation level while in motion. FIG. 11 shows an embodiment of the invention when applied to such vessels. The figure illustrates a vessel 50 with a water line 51 which is at all times situated below a reaction chamber 52 provided aft. A helical or screw propeller 59 is fitted onto the output shaft 58 of the motor 57 which extends through the reaction chamber 52.

Underneath the hull of the vessel 50 is a water intake 53 connected to an aperture 56 leading horizontally into the chamber 52 via a conduit 54 in the circuit which includes a pump 55.

In this embodiment of the invention, in view of the fact that the vessel is not intended to move on the hydroplane principle, no high dynamic pressure can be relied upon, so that a feed pump 55 is required to provide a pressure to generate a horizontal jet which will be subdivided by the propeller 59, so that each separate segment of the water jet is projected into the air at an increased speed.

The embodiment shown in FIG. 11 is a device of the same type as that illustrated in FIGS. 1 to 4, and it is obvious that the turbine described in conjunction with FIGS. 5 to 10 could likewise be used in this embodiment.

In all the embodiments of the invention it has been assumed that a single jet of water is projected towards the rear. However, it is likewise possible to provide more than one jet, each jet being subdivided by the same device and each separate segment being projected with the said acceleration. It is further possible to provide a number of jets of water projected towards the rear, each jet being transformed by a corresponding device which would project, with an increase in speed, the separate jets of water which had been segmented from the original jet.

Needless to say, the invention is not confined to the embodiments specifically described and illustrated, the numerous modifications may be made thereto such as the substitution of a simple paddle wheel device for the turbine 21, without departing from the invention. The invention is instead to be construed as limited only by the scope of the claims.

What is claimed is:

1. A propulsion device for a nautical vessel positioned in water, for use during movement of the boat across the water, said device comprising:

(a) a water intake;

(b) a conduit for conveying water from said intake to an aperture at the rear of said boat, said water being forced through said aperture in the form of a water jet; and (c) a propeller attached to a shaft for driving said propeller to subdivide said water jet into segments and to project each of said segments directly into the air, without being subjected to a pressure other than air pressure, as segments with an acceleration.

2. The device as defined by claim 1 wherein said propeller comprises blades arranged to rotate perpendicular to the trajectory of said water jet.

3. The device as defined by claim 1 further comprising means for regulating the cross-section of said jet.

4. The device as defined by claim 3 wherein said means comprises slits at the end of a nozzle and a ring having a frustoconical bore.

5. The device as defined by claim 1 wherein said device is used on said nautical vessel, said propeller being positioned in a reaction chamber located in the aft section of said vessel.

6. The device as defined by claim 5 wherein said aperture opens into said reaction chamber.

7. The device as defined by claim 5 wherein said reaction chamber is positioned on a level of said vessel such that said reaction chamber is partially submerged when said vessel is motionless and said propeller is at least partially submerged.

8. The device as defined by claim 7 wherein said nautical vessel is a hydroplane.

9. The device as defined by claim 8 wherein said propeller serves as a starting proplusion device for said hydroplane.

10. The device as defined by claim 1 wherein said propeller includes a central axis, said water jet is conveyed to said propeller in a direction parallel to said axis and each of said segments is projected outwardly from said propeller in a direction substantially parallel to said axis.

11. The device as defined by claim 1 wherein said propeller has blades which are arranged so as to comprise means for attacking said water jet at an angle which is substantially perpendicular to the trajectory of said water jet.

12. The device as defined by claim 11 wherein said blades translate in rotation while being arranged in parallel planes.

13. The device as defined by claim 1 further comprising a reaction chamber, at least part of said propeller and part of said reaction chamber located above said water.

14. A method of propelling a nautical vessel through water, said method comprising:

(a) flowing water through a water intake in the said vessel;

(b) conveying said water through a conduit from said intake to an aperture towards the rear of said vessel;

(c) forcing said water through said aperture in the form of a water jet; and (d) subdividing said water jet into segments by means of a propeller and projecting each of said segments directly into the air as segments with an acceleration by said propeller without being subjected to a pressure other than air pressure so as to provide a reaction force for propelling said nautical vessel.

* * * * *